US012624931B2

(12) United States Patent
Ruiz Hernández et al.

(10) Patent No.: US 12,624,931 B2
(45) Date of Patent: May 12, 2026

(54) DEVICE AND METHOD FOR ROBOTISED PRIMING

(71) Applicant: ENAEX SERVICIOS S.A., Las Condes (CL)

(72) Inventors: Marco Antonio Ruiz Hernández, Las Condes (CL); Jonhatan Octavio Barriga Melgarejo, Las Condes (CL); Rodrigo Andrés Miranda Lorca, Las Condes (CL); Gloria del Pilar Lara Marro, Las Condes (CL)

(73) Assignee: ENAEX SERVICIOS S.A., Las Condes (CL)

( * ) Notice: Subject to any disclaimer, the term of this patent is extended or adjusted under 35 U.S.C. 154(b) by 57 days.

(21) Appl. No.: 18/856,495

(22) PCT Filed: Apr. 12, 2022

(86) PCT No.: PCT/CL2022/050032
§ 371 (c)(1),
(2) Date: Oct. 11, 2024

(87) PCT Pub. No.: WO2023/197087
PCT Pub. Date: Oct. 19, 2023

(65) Prior Publication Data

US 2026/0036409 A1 Feb. 5, 2026

(51) Int. Cl.
*F42B 3/26* (2006.01)
*F42D 1/08* (2006.01)
*F42D 5/00* (2006.01)

(52) U.S. Cl.
CPC ..... *F42B 3/26* (2013.01); *F42D 1/08* (2013.01); *F42D 5/00* (2013.01)

(58) Field of Classification Search
CPC ..... F42B 3/26; F42D 5/00
See application file for complete search history.

*Primary Examiner* — Reginald S Tillman, Jr.
(74) *Attorney, Agent, or Firm* — David R. Stevens; Stevens Law Group

(57) ABSTRACT

The present disclosure relates to a robotic priming device for an explosive priming process. One aspect includes at least one initiator dispenser, each comprising a plurality of initiator racks containing a plurality of initiators. Each initiator dispenser includes one or more initiator discharge wheels that discharge the initiators onto an initiator cart. The device includes at least one detonating assembly dispenser, each comprising a plurality of detonating assembly racks containing a plurality of detonating assemblies. Each detonating assembly dispenser comprises one or more detonating assembly unloading wheels that unload the detonating assemblies onto a detonating assembly cart. The device includes a meeting and priming line with a meeting and priming zone. The detonating assembly cart locates the detonating assemblies in the meeting and priming zone. The initiator cart moves the initiators to the meeting and priming zone, and inserts the initiators into the detonating assembly to form an explosive primer.

12 Claims, 6 Drawing Sheets

DEVICE AND METHOD FOR ROBOTISED PRIMING

FIELD OF THE INVENTION

The present invention relates to systems and equipment used for tunnel development, and more specifically to various technologies associated with drilling and blasting. In particular, a robotic system for priming explosives is described.

STATE OF THE ART

Many high-risk tasks are currently carried out in the mining industry in person, with the assistance of multiple workers who must perform risky tasks in risky areas. In the case of explosives loading in mining, and in particular in subway mining, the work must be carried out by crews of workers at the blasting site, where such work includes, for example, inspection and cleaning of the face and the respective drill holes, priming and insertion of detonators and explosives in each hole and the connection of all detonators.

Priming involves the insertion of detonators inside initiators, primers or boosters containing charges of high explosive material, forming explosive primers that are then inserted into rock face perforations known as drafts. The components to form the explosive primers must be transported separately for safety reasons, as this reduces the likelihood for the detonator to assembly off the charges before being introduced into the rock face perforations.

To carry out the priming work, operators must manually insert the detonators into the respective initiators and then insert each assembly into the corresponding drill hole. Usually, these tasks are performed manually in the same blasting face, exposing personnel to possible rock falls or explosions, or to other events that can cause serious injuries to personnel, such as cuts, contusions, fractures, and even death.

There are other risks and disadvantages associated with the presence of personnel in blasting areas. For example, after each blasting there is a ventilation period that can vary between 1 and 5 hours, depending on the conditions of each mine and the level of gases present, in which period personnel cannot access the area. These ventilation times imply a period of non-activity in the area, which translates into a decrease in productivity.

Along the same line of reasoning, there are areas in mining sites that are unstable and have the potential for landslides, which prevents personnel from accessing these areas to mine the ore. This significantly affects the productivity of the mine because even when there are areas with valuable resources, many of these areas remain unexploited because of the high risk to personnel.

As can be seen from the above description, the priming process currently involves a large amount of work that must be carried out by multiple people duly qualified for these actions. All these efforts result in a great amount of man hours and high risks for the personnel involved in these operations, to the extent that even their lives can be compromised.

In view of these limitations, it follows that in the current state of the art there is a need for a system that can carry out all the tasks associated with the priming work autonomously, semi-autonomously or by remote control, so as to completely avoid the intervention of people in this process within the blasting area.

Among what is known, we can mention publication WO2017214422A1, which describes a robot-automated mining method, wherein the method includes a robot that places a charge component for entry into a drill hole. Further described is a priming device with a magazine containing a plurality of detonator packages, wherein each detonator package includes an initiator, a detonator, and a signal wire. The magazine includes a first area for holding detonators with respective signal wires preconnected thereto and a second area for containing the initiators. The magazine allows multiple initiators to be primed at the same time within the second area containing the initiators and subsequently a robotic part manipulates the assembled explosive primers. However, the described technology has safety shortcomings, since it stores the initiators and detonators all together in the same magazine, and also assembles and stores the assembled explosive primers together with the explosive initiators without priming, thus increasing the probability of accidental detonation of one or multiple charges and may even cause the explosion of all the charges inside a magazine.

Another document is publication US20180106584A1, which describes a vehicle configured for deposition of explosives in open pit mine shafts, where the vehicle uses a robotic arm with claw-like devices to assemble a weighted detonator in an open pit mining environment. However, the described technology is not suitable for subway mining environments, as it describes a bulky device where the assembly of the explosive primers is performed by claws that can drop the explosive elements in wet environments or upon impact, where the explosive primers could hit metal elements and cause an accidental detonation.

In view of the problems described above, having new priming systems that provide greater safety in priming and reduce the possibility of accidental detonation of one or multiple explosive charges is necessary.

SUMMARY DESCRIPTION OF THE INVENTION

The present technology describes a priming device and a priming method that provides greater safety in priming and reduces the possibility of accidental detonation of single or multiple explosive charges, wherein the device comprises at least two dispensers, one that stores and delivers initiators, and another that stores and delivers detonator assemblies consisting of detonators plus polymeric shields. Each dispenser has a plurality of racks that vertically store initiators, or detonator assemblies as appropriate and deliver them to transport carts. The various dispensers are mounted separately from each other to reduce the chances of accidental contact between initiators and detonating assemblies. Additionally, the priming device of the present technology keeps all its components inside protective covers, i.e., it is an enclosed machinery that reduces the exposure of both explosive primers and detonators to unfavorable environmental conditions and rock falls.

The reception of the initiators is done in a cart that transfers and deposits the initiator in the line that takes it to a priming zone, while the detonator assembly is also taken to the priming zone in its respective cart. The detonator assembly is positioned and awaits the initiator, which is pushed against the detonator until the latter is inserted inside it, forming the explosive primer and thus concluding the priming stage. The explosive primer is then transferred to an elevator cart, which delivers the explosive primer and makes it available for use.

DETAILED DESCRIPTION OF THE INVENTION

Figure 1:
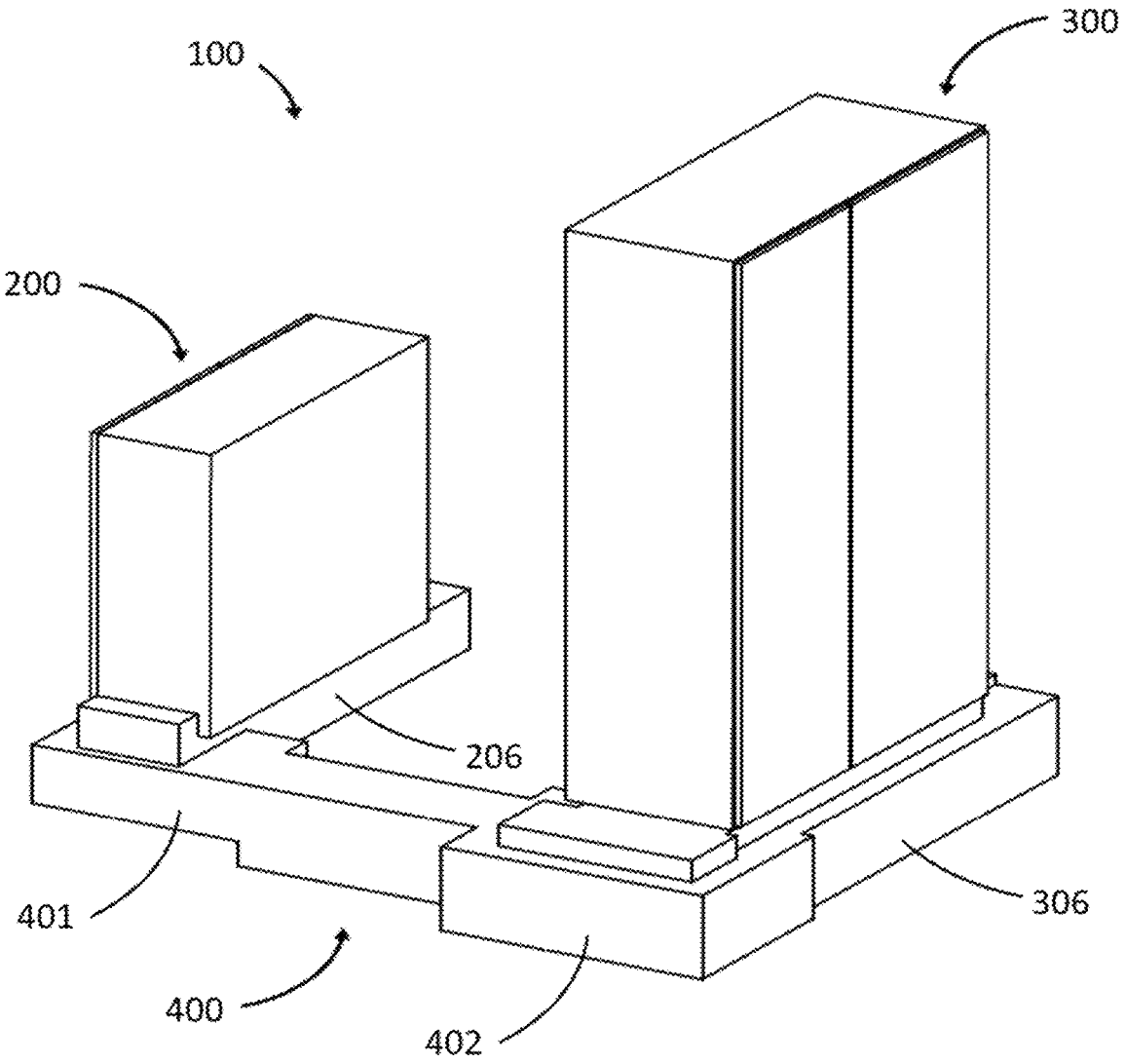
FIG. 1 shows a schematic view of an exemplary embodiment of a priming device according to the present technology.

Exemplary embodiments are described in detail below to illustrate the principles of the invention. The embodiments are provided to illustrate aspects of the invention, but the invention is not limited to any one embodiment. The scope of the invention encompasses numerous alternatives, modifications and equivalents, only limited by the embodiments of the claims.

In an exemplary embodiment of the present technology, a priming device is described comprising at least one initiator dispenser, wherein each initiator dispenser comprises a plurality of initiator racks containing initiators stacked one above the other, wherein the initiator dispenser further comprises initiator discharge wheels that discharge initiators to a primer cart that moves initiators on guides or rails; at least one detonating assembly dispenser, wherein each detonating assembly dispenser comprises a plurality of detonating assembly racks containing detonating assemblies stacked on top of each other; wherein the detonating assembly dispenser further comprises detonating assembly unloading wheels that unload the detonating assemblies to a detonating assembly cart that moves the detonating assemblies on guides or rails.

The device further comprises a meeting and priming line with a meeting and priming zone, wherein the detonating assembly cart locates the detonators in the meeting and priming zone, wherein the initiator cart moves the initiators through an intermediate zone to the meeting and priming zone, wherein the initiator cart pushes the initiators against the detonating assembly in the meeting and priming zone to form a priming; wherein the detonating assemblies employed may be hardwired or wireless.

Although transport of the initiator may be accomplished by a single initiator cart that moves the initiators from the initiators discharge wheels to the meeting and priming zone, in an alternative embodiment of the present technology, the initiator cart transfers the initiators to an intermediate transport cart that moves the initiators through the intermediate zone to the meeting and priming zone, where the intermediate transport cart pushes the initiators against the detonator assembly in the meeting and priming zone to form an explosive primer.

In an exemplary modality, to regulate the drop of the detonator and initiator assemblies, discharge wheels are used, which are activated by means of actuators that make them rotate, allowing the detonator and initiator assemblies to be housed inside a housing of the discharge wheel. The initiators and detonators are moved by means of motorized spindles, belt systems or others, where all the mechanical elements and components are made of stainless steel, polyamide and rubber to prevent accidental detonation of the explosive elements.

In an alternative embodiment, the present technology further includes an explosive primer delivery system comprising an explosive primer elevator that receives the explosive primer from the meeting and priming area and moves it to a delivery area. The explosive prime elevator is a mechanical system that lifts the explosive primer and may be for example a platform, a powered enclosed elevator or a trolley lift, among other embodiments.

With respect to FIG. 1 it can be seen that it shows a schematic view of an exemplary embodiment of a priming device 100 according to the present technology, wherein the initiator dispenser 200 is visualized separate from the detonator dispenser 300 and wherein it can be seen that the transport zones 206, 306, 401 through which both the initiators 202 and the detonator assemblies 302 are moved, as well as also the meeting and priming line 400, wherein said transport zones 206, 306, 401 are covered to protect the explosive components from rock falls and accidental blows.

Figure 2:
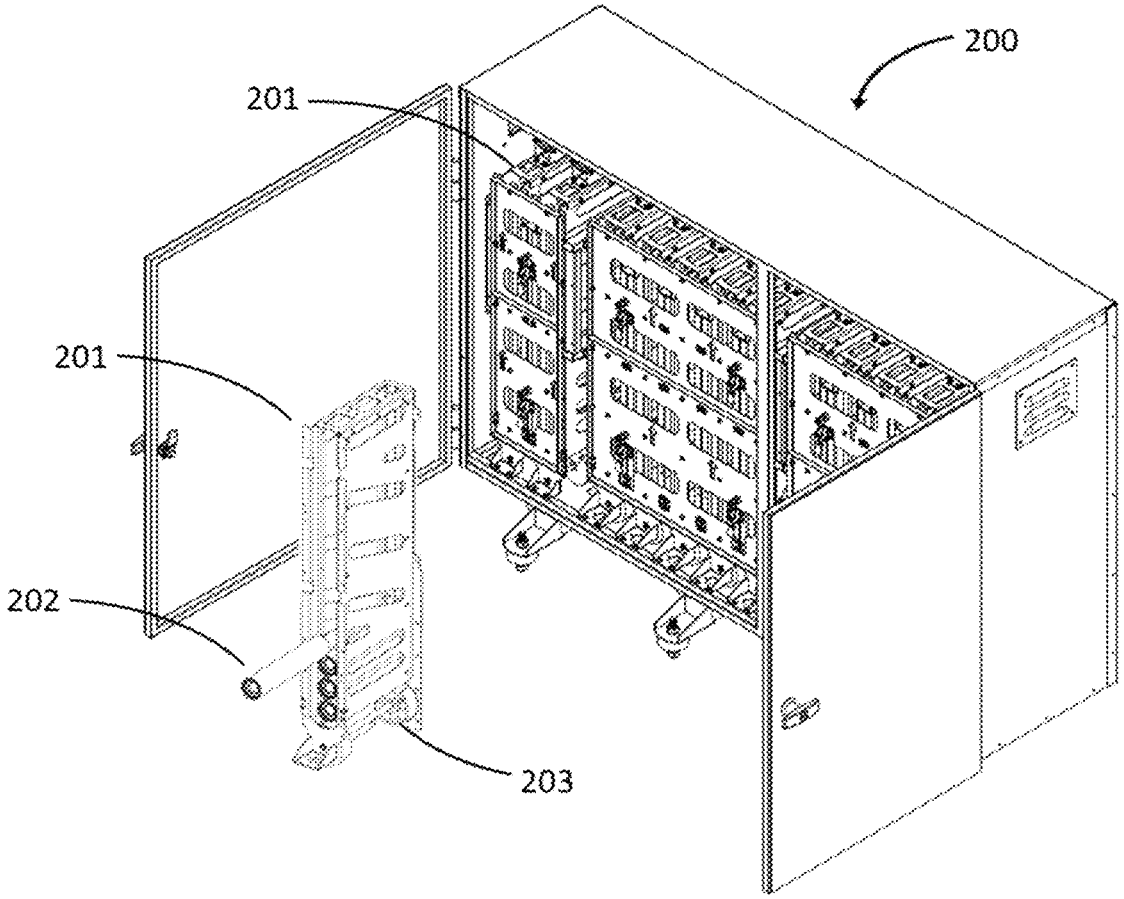
FIG. 2 shows a schematic view of an initiator dispenser according to an exemplary embodiment of the present technology.

With respect to FIG. 2 it can be seen that it shows a schematic view of an initiator dispenser 200 according to an exemplary embodiment of the present technology, wherein a separate initiator rack 201 is shown separate from the initiator dispenser 200 to illustrate more clearly the arrangement of the initiators 202 inside the different initiator racks 201. At the same time, it is seen at the bottom of the separate initiator rack 201 that it further comprises a primer unloading wheel 203 that allows the initiators 202 to be removed from the initiator dispenses 200 one at a time.

Figure 3:
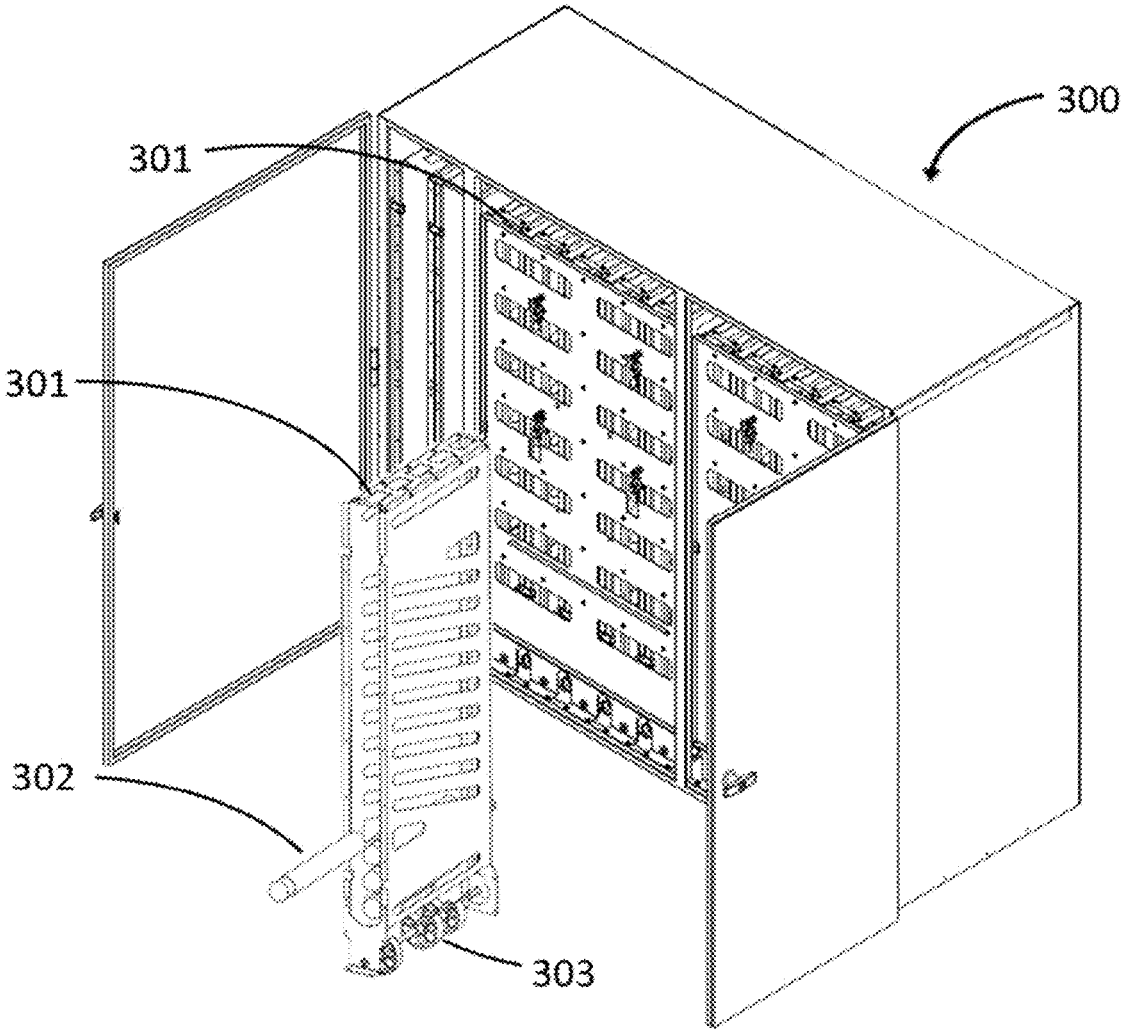
FIG. 3 shows a schematic view of a detonator dispenser according to an exemplary embodiment of the present technology.

With respect to FIG. 3 it can be seen that it shows a schematic view of a detonating assembly dispenser 300, in a manner equivalent to that shown in FIG. 2 with reference to the initiators 202. FIG. 3 shows a detonating assembly rack 301 separate from the detonating assembly dispenser 300 to illustrate more clearly the arrangement of the detonating assemblies 302 within the various detonating assembly racks 301. At the same time, it is seen on the underside of the separate detonating assembly rack 301 that it comprises a detonating assembly unloading wheel 303 that allows the detonating assemblies 302 to be removed one at a time, in a manner equivalent to that illustrated for the initiators in FIG. 2.

Figure 4:
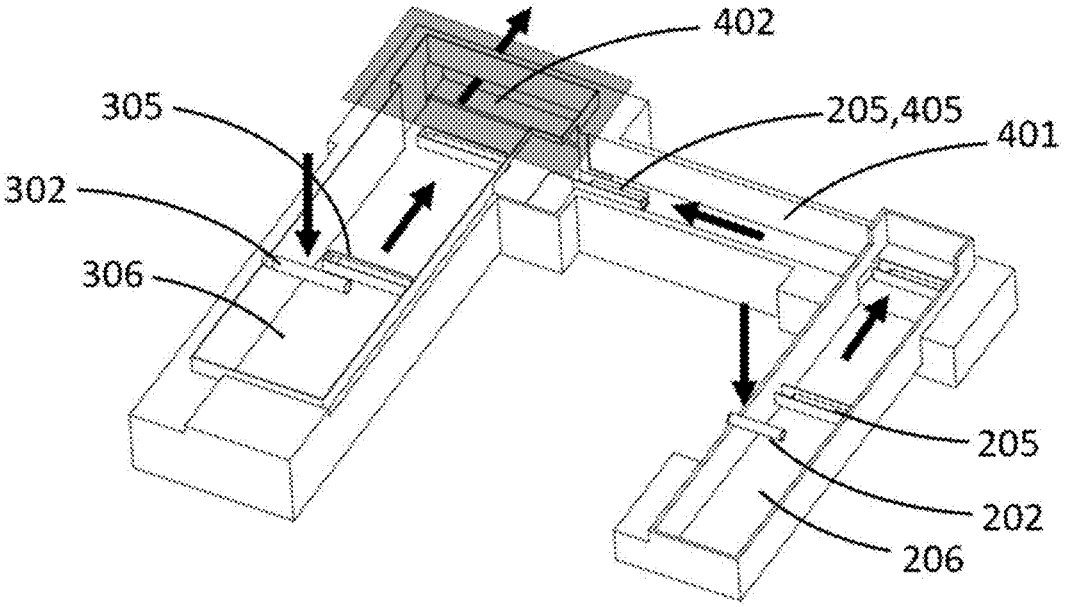
FIG. 4 shows a schematic view of an exemplary embodiment of the paths taken by the initiators and detonating assemblies during assembly of the explosive primers.

With respect to FIG. 4, it can be seen that it illustrates the routes taken by the initiators 202 and the detonating assemblies 302 during the assembly of the explosive primers. In an exemplary embodiment of the present technology, initiators 202 and detonating assemblies 302 are moved towards the priming zone by means of carts 205, 305, 405 powered conveyors, wherein initiators 202 are transported by means of a cart 205, 405 through an initiator transport zone 206 and an intermediate transport zone 401 to a meeting and priming zone 402, while detonating assemblies 302 are transported by means of a detonating assembly cart 305 to the meeting and priming zone 402. It is noted that the carts 205, 305, 405 driven conveyors may be wheeled conveyors, conveyors on rails, conveyors on toothed guides or conveyors on threaded guides, among others.

Figure 5:
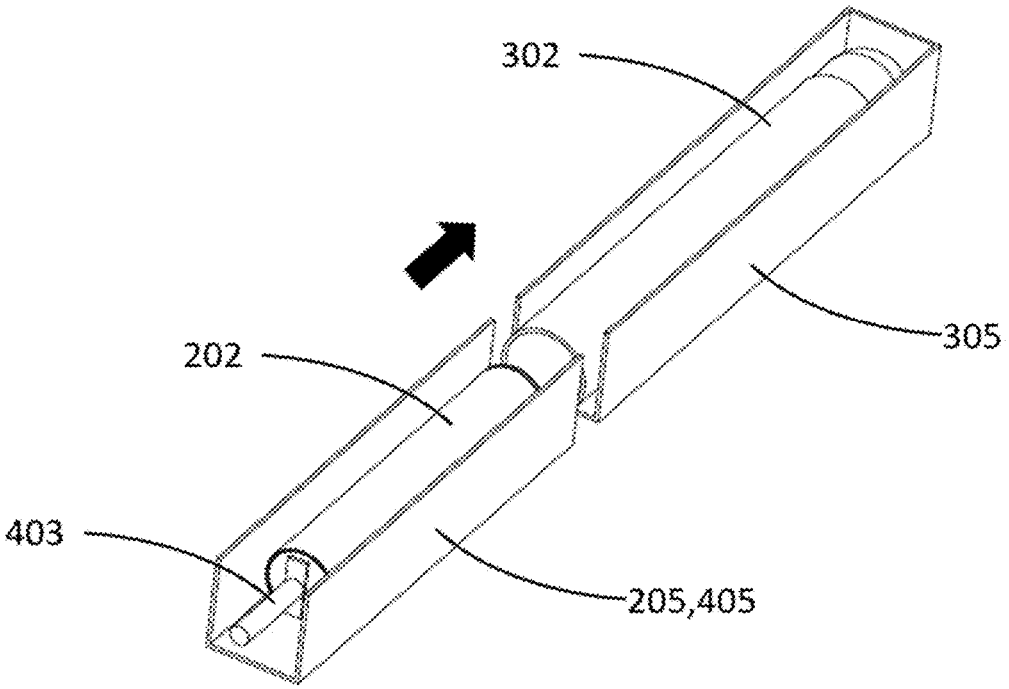
FIG. 5 shows a schematic view of an initiator and detonator assembly in the priming zone.

FIG. 5 shows a schematic view of an initiator 202 and a detonator assembly 302 within the meeting and priming zone 402, wherein the initiator 202 and the detonator assembly 302 are held in position by a support structure of the carts 205, 305, 405 driven carriers that allows aligning the initiator 202 with the detonator assembly 302 and also prevents its transverse displacement. In this way, a pusher device 403 pushes the explosive primer towards the interior of the detonator assembly during the priming operation, wherein said pusher device may be a fixed element within one of the carts 205, 305, 405 driven conveyors.

Figure 6:
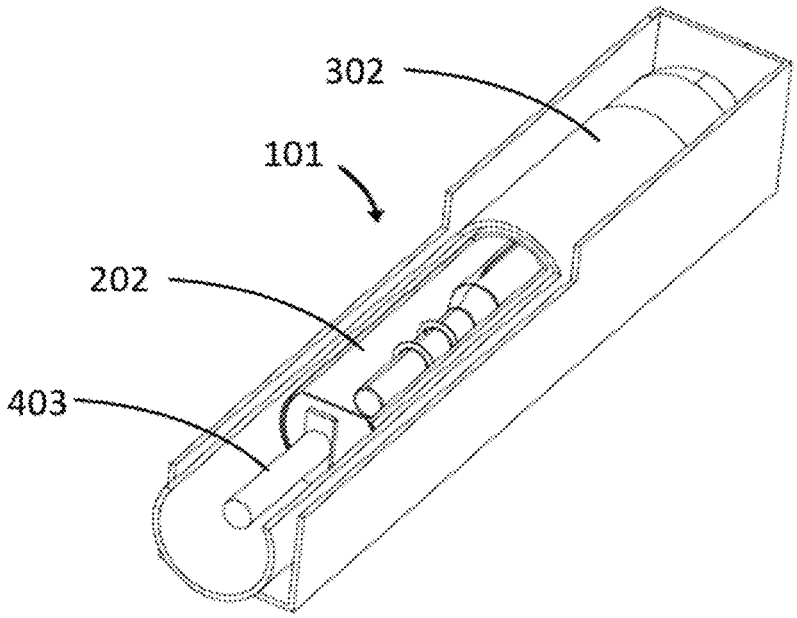
FIG. 6 shows a schematic view of an explosive primer assembled in the priming zone with a partial cutout to illustrate the interior of the primer.

FIG. 6 shows an assembled explosive primer 101 with a partial cutaway view to illustrate the interior of the explosive primer 101, showing the general arrangement of the initiator 202 and detonator assembly 302 once the pusher device 403 has pushed them together axially.

Figure 7:
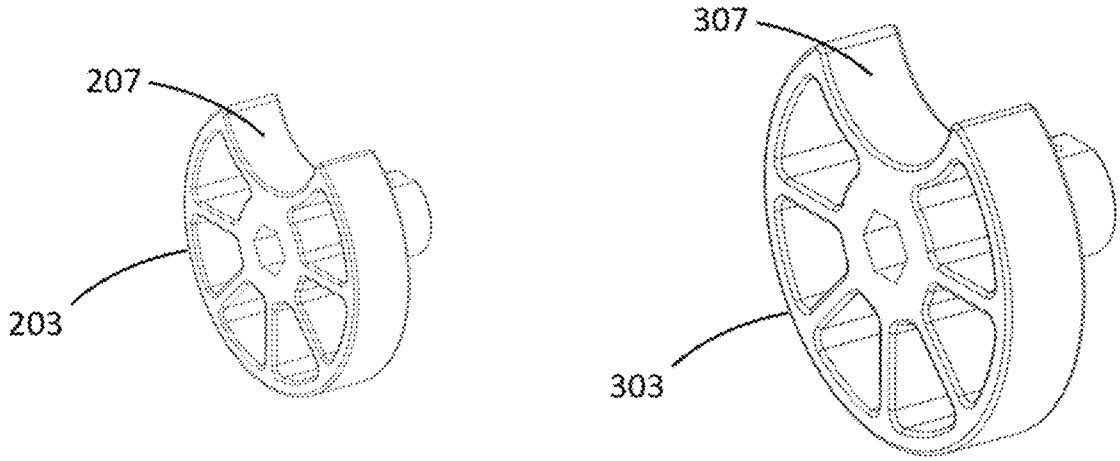
FIG. 7 shows a schematic view of an initiator discharge wheel and a detonator assembly discharge wheel.

FIG. 7 shows a schematic view of an initiator discharge wheel 203 with an initiator housing 207 and a detonating assembly discharge wheel 303 with a detonator housing 307, being noted that both semicircular housings allow an initiator 202 or a detonating assembly 302 to be housed from one of their respective frames, wherein the initiator discharge wheel 203. This configuration of discharge wheels with semicircular housings allows the explosive primer components to be removed one at a time without the initiator 202 or detonator assembly 302 being removed from the frame being dropped or knocked. At the same time, the discharge wheels allow blocking the exit of initiators 202 and detonator assemblies 302 that are housed in the racks, reducing the possibility of accidental discharge or dropping of the primer components, improving the safety of the priming process.

Figure 8:
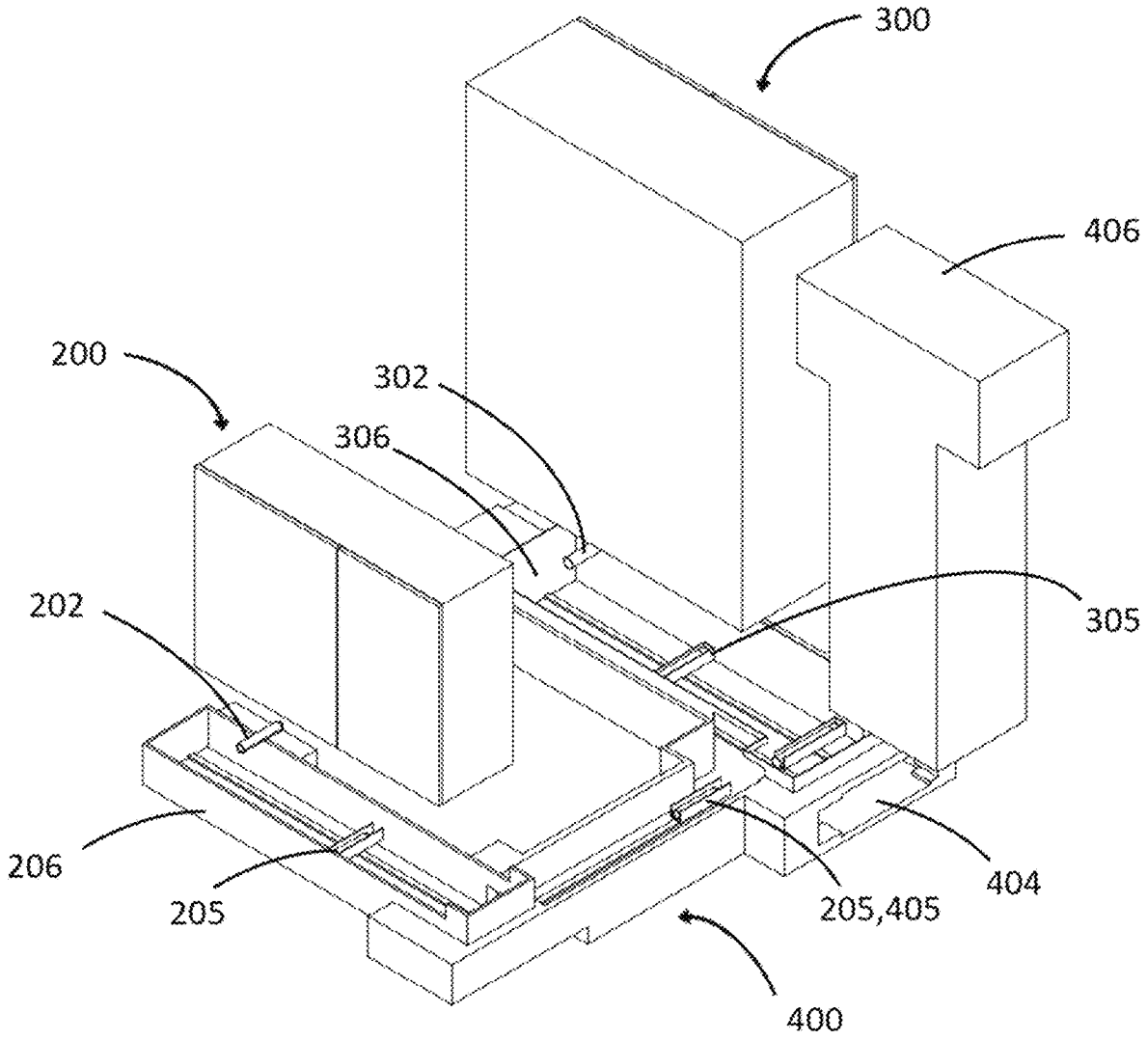
FIG. 8 shows a schematic view of another exemplary embodiment of a priming device according to the present technology.

FIG. 8 shows a schematic view of an exemplary embodiment of a priming device according to the present technology where the transport of initiators and detonating assemblies is performed by means of transport carts. At the same time, it can be appreciated that, in some embodiments of the present technology, the priming system may incorporate a primer lifter that extracts the explosive primers from the priming zone and lifts them to a position available for use, where they can be manipulated either by a person or by an automated system. In addition, exit gate 404 is illustrated that allows the primer to be removed from the priming area for use, either by an automated system or by manual removal by a person.

In one embodiment, the present technology relates to a priming device comprising: at least one initiator dispenser, wherein each initiator dispenser comprises a plurality of initiator racks containing initiators stacked one on top of the other; wherein the initiator dispenser further comprises initiator discharge wheels that discharge initiators onto a cart of initiators; at least one detonating assembly dispenser, wherein each detonating assembly dispenser comprises a plurality of detonating assembly racks containing detonating assemblies stacked one on top of the other; wherein the detonating assembly dispenser further comprises detonating assembly unloading wheels that unload the detonating assemblies onto a detonating assembly cart; a meeting and priming line with a meeting and priming zone, wherein the detonating assembly cart locates the detonators in the meeting and priming zone, wherein the initiator cart moves the initiators through an intermediate zone to the meeting and priming zone, wherein the initiator cart inserts the initiators into the detonating assembly in the meeting and priming zone to form an explosive primer.

In an alternative embodiment, the priming device further comprises an exit area for the explosive primer that allows receiving the explosive prime delivered by the priming device, either to be delivered to a system dependent on the priming device for an automatic robotic loading system that moves the explosive primer to its final position in the borehole, or to be delivered to an auxiliary robotic loading system of the priming device that moves the explosive primer to its final position in the borehole, or to be delivered to a human operator who is required to manually load the explosive primer, if required. This reduces the exposure of assembled explosive primers to the working environment where they could be accidentally detonated and at the same time reduces the exposure of personnel to the assembled or in process of being assembled explosive primers.

In an alternative embodiment, the priming device further comprises a delivery system of explosive primers comprising an explosive primer elevator that receives the primer from the meeting and priming zone and moves it to a delivery zone that allows the explosive primer to be brought close to the loading point for removal by a robotic loading system dependent on the priming device that carries the explosive primer to the bottom of the borehole, or allows to bring the primer close to the loading point and deliver it to a human operator who requires to manually load the explosive primer, if required.

In an alternative embodiment, the priming device further comprises a processor operatively connected to a user interface with each initiator dispenser and each detonating assembly dispenser. The user interface allows activating the priming device and allows monitoring each step of the priming process by receiving telemetry from the different components of the system, such as the racks, the transport carts, the locking devices among others, where it also allows operators to take manual control of the actuation of the priming device components if necessary. In addition, the processor is configured to deliver status data for each stage of the process from the dispensing of detonators and initiators to the delivery of the explosive primer.

In an alternative embodiment, the initiator dispenser, the detonating assembly dispenser and the meeting and priming line further comprise external protections covering the entire path taken by the initiators and detonating assemblies to the priming zone. These protections protect both the elements that form the explosive primer and the fixed and mobile components of the priming device without exposing the priming elements to accidental shocks and manipulations from the outside.

In an alternative embodiment, the processor is operatively connected to locking means that block the opening of the exit area of the explosive primer during the priming process. In this way, the entire priming operation is performed inside the priming device, preventing accidental manipulations from the outside, and at the same time protecting nearby personnel and equipment in case of an accidental detonation.

In an alternative embodiment, each initiator further comprises an initiator identifier and wherein each detonating assembly further comprises a detonating assembly identifier, allowing for record keeping and traceability of the components employed and further determining how many initiators and detonating assemblies are in each rack.

In an alternative embodiment, the initiator dispenser further comprises an initiator processor operatively connected to readout means that read information from the initiator identifiers.

In an alternative embodiment, the detonator assembly dispenser further comprises a detonator processor operatively connected to readout means that read information from the detonator identifiers.

In an alternative embodiment, the processor is connected to a computer-readable memory device that stores information with respect to initiator identifiers and detonator identifiers stored in the dispensers, as well as stores information with respect to initiator identifiers and detonator identifiers that have been used in priming operations.

In one embodiment, the present technology relates to a priming method comprising the steps of:

- entering a command to start the priming job via a user interface that communicates operationally with a processor,
- positioning a detonating assembly on a detonating assembly cart from a detonating assembly rack in a detonating assembly dispenser by means of detonating assembly unloading wheels;
- moving the detonating assembly to a meeting and priming zone;
- positioning an initiator on an initiator cart from an initiator rack in an initiator dispenser by means of initiator unloading wheels;
- moving the initiator to a meeting and priming zone; and
- introducing the initiator inside the detonator assembly in the meeting and priming zone to form an explosive primer.

In an alternative embodiment, the method further comprises delivering the explosive primer in an explosive primer delivery zone by means of a primer delivery system.

In an alternative embodiment, the method further comprises sending an instruction to unblock the opening of the explosive primer outlet area to blocking means that block the opening of the explosive primer outlet area during the priming process.

The location of the detonator and initiator assemblies can be interchanged without altering the manner of operation of the priming process, whereby in another embodiment of the present technology there is a priming device that provides greater safety in the priming work and reduces the possibility of accidental detonation, comprising at least one initiator dispenser, wherein each initiator dispenser comprises a plurality of initiator racks containing initiators stacked one above the other; wherein the initiator dispenser further comprises initiator discharge wheels that discharge the initiators onto an initiator cart; at least one detonating assembly dispenser, wherein each detonating assembly dispenser comprises a plurality of detonating assembly racks containing detonating assemblies stacked one above the other; wherein the detonating assembly dispenser further comprises detonating assembly unloading wheels that unload the detonating assemblies onto a detonating assembly cart; a meet and priming line with a meet and priming zone, wherein the primer cart locates the primers in the meet and priming zone, wherein the detonating assemblies are moved by a cart through an intermediate zone to the meet and priming zone, wherein the cart inserts the detonating assemblies into the initiator in the meet and priming zone to form a prime.

APPLICATION EXAMPLES

In an example application of the present technology, a priming device according to the present technology was mounted on a motorized transport vehicle.

For this exemplary mode, an initiator dispenser with a capacity of one hundred and fifty initiators was used, separated into ten initiator racks with fifteen initiators each, where in each initiator rack the initiators were mounted stacked one on top of the other. The initiators are extracted from the initiator racks by means of initiator discharge wheels made of polyamide which when actuated drop the initiators by the action of gravity into an initiator housing of the initiator discharge wheel.

On the other hand, for this exemplary embodiment, a detonator dispenser with capacity for one hundred and sixty detonators was used, separated into eight detonator racks with twenty detonators each, where in each detonator rack the detonators were mounted stacked one on top of the other. The detonators are also extracted from the detonator racks by means of detonator assembly discharge wheels made of polyamide which, when actuated, drop the detonators by the action of gravity into a detonator housing of the detonator assembly discharge wheel.

The process starts by unloading an initiator from its dispenser onto a transfer means, which in this exemplary embodiment corresponds to a cart that moves it by mechanical means through the initiator transfer zone to a second cart that takes the initiator to the priming zone through an intermediate transport zone. In parallel, a detonator assembly is unloaded from the detonator dispenser onto a trolley that moves it through the detonator transport zone to the priming zone. In the priming zone, the detonator assembly is positioned with an opening facing the initiator, leaving the detonator tip free to await the initiator.

In the priming zone, the initiator arrives positioned with the opening for the detonator facing the detonator dispenser. Both the initiator and the detonator assembly are axially aligned. The detonator assembly remains in a support structure that prevents lateral movement of the detonator assembly and initiator while priming. The aligned initiator is pushed by pushing means, which in this exemplary embodiment corresponds to a paddle that slides it into the detonator assembly until the detonator is completely secured inside the primer opening.

The paddle is removed and the structure that supports the detonator opens and allows the movement of the joined initiator-detonator assembly, now called the explosive primer. The system delivers the explosive primer through a gate or through a conveyor mechanism to be removed either by a robotic system or by an operator.

The unloading from the dispensers, the transfer of the initiators and detonators, and the priming process are carried out automatically with a control system, supervised or not by a person.

The process was carried out iteratively more than 100 times with adjustments in the process times and in the mechanical systems for transferring initiators and detonators, obtaining 100% of correctly assembled primes.

REFERENCE NUMBERS

In order to clarify the present description, a list of the components of the invention and their respective reference numbers in the figures is incorporated below.

100 Priming device
101 Explosive primer
200 Initiator dispenser
201 Initiator rack
202 Initiators
203 Initiator unloading wheel
205 Initiator cart

206 Initiator transportation zone
207 Hosting of initiators
300 Dispenser of detonating assemblies
301 Detonating assemblies frame
302 Detonating assemblies
303 Detonating assembly unloading wheel
305 Detonating assembly cart
306 Detonator transport zone
307 Detonator housing
400 Meeting and priming zone
401 Intermediate transport zone
402 Meeting and priming zone
403 Pusher device
404 Exit Gate
405 Intermediate transport cart
406 Explosive primer elevator Finally, it should be noted that various particular parameters of the invention, such as dimensions, choice of materials, and specific aspects of the preferred configurations described above may vary or be modified depending on operating requirements. Accordingly, the specific configurations described above are not intended to be limiting, and such variations and/or modifications are within the spirit and scope of the invention.

The invention claimed is:

1. A priming device that provides safety in an explosive priming process and reduces a possibility of accidental detonation, comprising:

at least one initiator dispenser, wherein each initiator dispenser comprises a plurality of initiator racks containing a plurality of initiators stacked one on top of the other; wherein each initiator dispenser further comprises one or more initiator discharge wheels that discharge the initiators onto an initiator cart;

at least one detonating assembly dispenser, wherein each detonating assembly dispenser comprises a plurality of detonating assembly racks containing a plurality of detonating assemblies stacked one on top of the other; wherein each detonating assembly dispenser further comprises one or more detonating assembly unloading wheels that unload the detonating assemblies onto a detonating assembly cart;

a meeting and priming line with a meeting and priming zone, wherein the detonating assembly cart locates the detonating assembly in the meeting and priming zone, wherein the initiator cart moves the initiators through an intermediate zone to the meeting and priming zone, wherein the initiator cart inserts the initiators into the detonating assembly in the meeting and priming zone to form an explosive primer.

2. The priming device according to claim 1, further comprising an outlet area for the explosive primer.

3. The priming device according to claim 1, further comprising a delivery system for explosive primers comprising an explosive primer elevator that receives the explosive primer from the meeting and priming zone and transfers it to a delivery zone.

4. The priming device according to claim 1, wherein the cart that moves the initiators through the intermediate zone is the initiator cart.

5. The priming device according to claim 1, wherein the initiator cart transfers the initiator to an intermediate transport cart rather than through the intermediate zone, and wherein the intermediate transport cart transfers the initiators through the intermediate zone.

6. The priming device according to claim 1, further comprising a processor operatively connected to a user interface, to each initiator dispenser and to each detonating assembly dispenser.

7. The priming device according to claim 6, wherein the processor is operatively connected to locking means that block the opening of the output area of the explosive primer during the priming process.

8. The priming device according to claim 1, wherein the initiator dispenser, the detonating assembly dispenser and the meeting and priming line further comprise external protections covering the entire path taken by the initiators and detonating assemblies to the priming zone.

9. A priming method that provides safety in explosive priming and reduces the possibility of accidental detonation, comprising:

entering a command to start an explosive priming process via a user interface that communicates operationally with a processor, positioning a detonating assembly on a detonating assembly cart from a detonating assembly rack in a detonating assembly dispenser by means of detonating assembly unloading wheels;

moving the detonating assembly to a meeting and priming zone;

positioning an initiator on an initiator cart from an initiator rack in an initiator dispenser by means of initiator unloading wheels;

moving the initiator to a meeting and priming zone; and introducing the initiator inside the detonator assembly in the meeting and priming zone to form an explosive primer.

10. The priming method according to claim 9, further comprising delivering the explosive primer to a primer delivery zone by means of a primer delivery system.

11. The priming method according to claim 9, further comprising sending an instruction to unlock an opening of an output area of the explosive primer to a blocking means that block the opening of the explosive primer output area during the explosive priming process.

12. A priming device that provides safety in an explosive priming process and reduces a possibility of accidental detonation, comprising:

at least one initiator dispenser, wherein each initiator dispenser comprises a plurality of initiator racks containing a plurality of initiators stacked one on top of the other; wherein each initiator dispenser further comprises one or more initiator discharge wheels that discharge the initiators onto an initiator cart;

at least one detonating assembly dispenser, wherein each detonating assembly dispenser comprises a plurality of detonating assembly racks containing a plurality of detonating assemblies stacked one on top of the other; wherein each detonating assembly dispenser further comprises one or more detonating assembly unloading wheels that unload the detonating assemblies onto a detonating assembly cart;

a meeting and priming line with a meeting and priming zone, wherein the initiator cart locates the initiators in the meeting and priming zone, wherein the detonating assembly cart moves the detonating assemblies through an intermediate zone to the meeting and priming zone, wherein the detonating assembly cart inserts the detonating assembly into the initiator in the meeting and priming zone to form an explosive primer.

* * * * *